US008981267B2

(12) United States Patent
Baek et al.

(10) Patent No.: US 8,981,267 B2
(45) Date of Patent: Mar. 17, 2015

(54) COOKTOP HEATING ELEMENT WITH IMPROVED CONNECTION STRUCTURE

(75) Inventors: Seung Jo Baek, Seoul (KR); Young Jun Lee, Seoul (KR); Hyoung Jun Kim, Seoul (KR); Byeong Wook Park, Seoul (KR)

(73) Assignee: LG Electronics Inc., Seoul (KR)

( * ) Notice: Subject to any disclaimer, the term of this patent is extended or adjusted under 35 U.S.C. 154(b) by 1254 days.

(21) Appl. No.: 11/930,768

(22) Filed: Oct. 31, 2007

(65) Prior Publication Data

US 2008/0217323 A1 Sep. 11, 2008

(30) Foreign Application Priority Data

Mar. 8, 2007 (KR) ..... 10-2007-0022840

(51) Int. Cl.

| | |
|---|---|
| ***H05B 3/02*** | (2006.01) |
| ***H05B 3/08*** | (2006.01) |
| ***H05B 3/00*** | (2006.01) |
| ***H05B 3/68*** | (2006.01) |

(52) U.S. Cl.

CPC ..... *H05B 3/08* (2013.01); *H05B 3/0076* (2013.01); *H05B 3/68* (2013.01); *H05B 2203/016* (2013.01); *H05B 2203/032* (2013.01)

USPC ..... 219/546; 219/549; 219/553; 219/459.1

(58) Field of Classification Search

USPC ..... 219/538, 553, 459.1, 458.1, 443.1, 385, 219/453.11, 451.1, 541, 507, 465.1, 468.1; 439/96, 101, 928

See application file for complete search history.

(56) References Cited

U.S. PATENT DOCUMENTS

| | | | | |
|---|---|---|---|---|
| 3,624,589 | A * | 11/1971 | Drouin | 439/131 |
| 3,750,092 | A * | 7/1973 | Bury | 439/357 |
| 4,381,444 | A * | 4/1983 | DeLong et al. | 219/453.14 |
| 4,467,181 | A * | 8/1984 | Fischer et al. | 219/459.1 |
| 4,899,033 | A * | 2/1990 | Kicherer et al. | 219/458.1 |
| 5,122,639 | A * | 6/1992 | Kicherer et al. | 219/458.1 |
| 6,293,811 | B1 * | 9/2001 | Frantz | 439/101 |
| 2001/0055478 | A1 | 12/2001 | Scherzer et al. | |
| 2004/0074893 | A1 * | 4/2004 | Wermbter et al. | 219/465.1 |

FOREIGN PATENT DOCUMENTS

| | | |
|---|---|---|
| CN | 1735288 | 2/2006 |
| DE | 44 19 285 | 12/1995 |

(Continued)

OTHER PUBLICATIONS

International Search Report dated Jul. 7, 2009.

(Continued)

*Primary Examiner* — Henry Yuen
*Assistant Examiner* — John J Norton
(74) *Attorney, Agent, or Firm* — KED & Associates, LLP

(57) ABSTRACT

A heating device having an improved heat resistance structure is provided. The heating device may include a heating element that generates heat, and an elastic conductive part that applies electricity to the heating element. A connector may be provided between the elastic conductive part and the heating element to preclude direct contact between the heating element and the elastic conductive part. The heating element may be fixed to one side of the connector, and the elastic conductive part may be fixed to the other side of the connector to allow current applied from the elastic conductive part to flow to the heating element.

18 Claims, 7 Drawing Sheets

(56) References Cited

FOREIGN PATENT DOCUMENTS

| | | |
|---|---|---|
| DE | 44 41 204 | 5/1996 |
| EP | 0 304 906 | 3/1989 |
| EP | 0 619 629 | 10/1994 |
| EP | 0 881 858 | 12/1998 |
| EP | 1 168 418 | 1/2002 |
| EP | 1 622 423 | 2/2006 |
| EP | 1 775 997 | 4/2007 |
| JP | 2000-294362 | 10/2000 |
| JP | 2000294362 A * | 10/2000 |
| JP | 2002-367568 | 12/2002 |

OTHER PUBLICATIONS

Korean Notice of Allowance issued in Application No. 10-2007-0022840 dated Jul. 22, 2013.

Chinese Office Action dated May 11, 2012.

European Search Report issued in EP Application No. 07833501 dated Feb. 21, 2012.

* cited by examiner

COOKTOP HEATING ELEMENT WITH IMPROVED CONNECTION STRUCTURE

This application claims the benefit of Korean Patent Application No. 10-2007-0022840 filed on Mar. 8, 2007, the entirety of which is incorporated herein by reference.

BACKGROUND

1. Field

This relates to a heating device, and more specifically to a heating device having improved heat resistance.

2. Background

Generally, a ramp heater is a heating device that generates heat through resistance generated by a heating element installed in a closed container. These types of heaters often experience overheating and/or damage at high power levels, sometimes due to the dissimilar materials used in their fabrication. Additionally, fabrication can be complex due to the interaction of the various parts and materials used.

BRIEF DESCRIPTION OF THE DRAWINGS

The embodiments will be described in detail with reference to the following drawings in which like reference numerals refer to like elements wherein.

DETAILED DESCRIPTION

Figure 1:
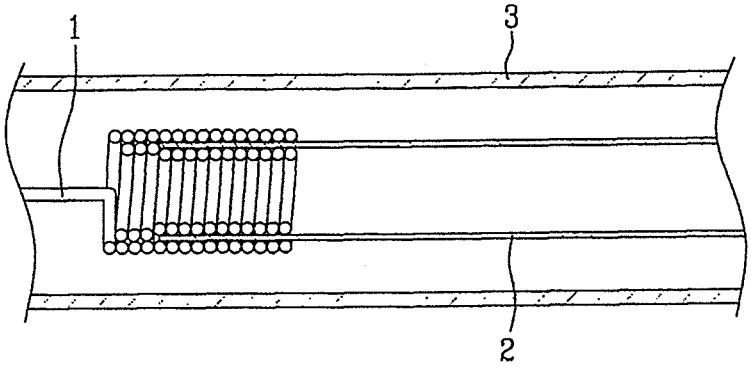
FIG. 1 PRIOR ART
FIG. 1 is a cross-sectional view of an exemplary heating device.
Figure 2:
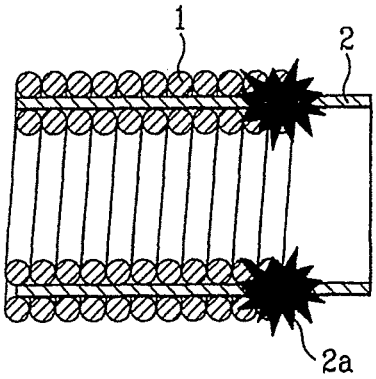
FIG. 2 PRIOR ART
FIG. 2 is an enlarged cross-sectional view of the exemplary heating device shown in FIG. 1.

The exemplary heater shown in FIG. 1 may include a heating element 2 that generates heat by resistance when an external voltage is applied, a closed container 3 having the heating element 2 installed therein, and a conductor 1 through which voltage may be applied to the heating element 2. The conductor 1 may include, for example, an outer spring and an inner spring, with the heating element 2 positioned therebetween.

External power, in the form of, for example, electricity, may be applied to the heating element 2 through the conductor 1. In certain embodiments, the conductor 1 may have a coil spring shape in order to maintain tension on the heating element 2. Thus, the heating element 2 and the conductor 1 may form contacts at several points.

In certain embodiments, the electrical resistance of the heating element 2 may generally be greater than that of the conductor 1. Accordingly, although the electrical resistances at all of the contact points of the conductor 1 and the heating element 2 may be substantially the same, the current passing a first contact point may be less than the current passing the next contact point, with the most current passing through a last contact point 2*a*.

If a high power level is required for the heating element 2, a large current may be applied to the heating element 2 through the conductor 1 to generate the desired power. However, in this instance, since a great amount of current would pass through the last contact point 2*a*, the last contact point 2*a* would experience a dramatic temperature increase, causing possible damage to the heating element 2 or the conductor 1 at this point. This has even more impact in a structure having a heating element 2 and a conductor 1 made of dissimilar materials such as, for example, a heating element 2 made of a carbon material and a conductor made of a molybdenum material.

To improve thermal characteristics of the heater, the heating element 2 may be formed as a fiber such as, for example, a carbon fiber made of carbon material. However, a heating element 2 made of a carbon fiber material is flexible, similar to cloth. Thus, it may be difficult to insert such a flexible heating element 2 into the space between the outer spring and the inner spring of the conductor 1.

Figure 3:
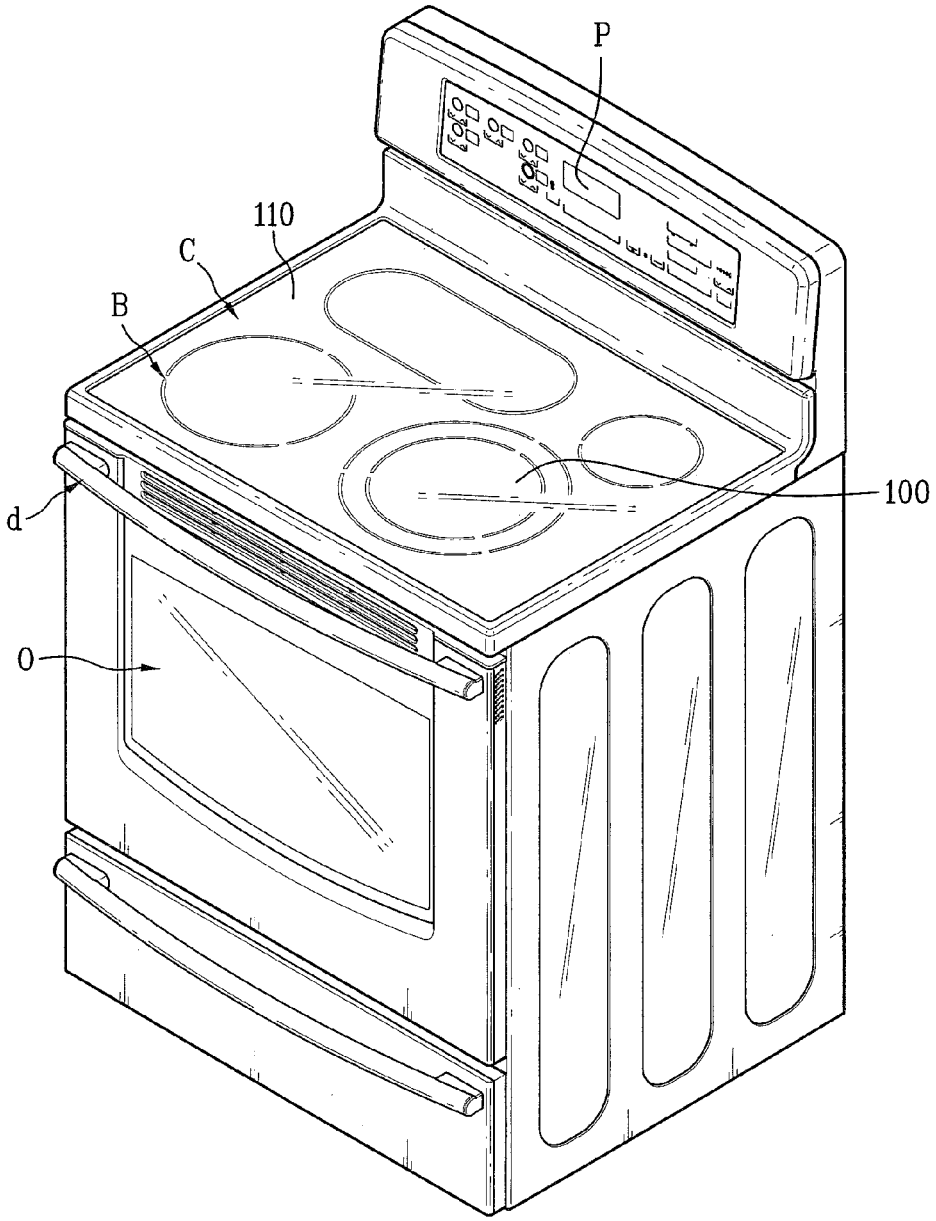
FIG. 3 is a perspective view of an exemplary cooking apparatus to which a heating device as embodied and broadly described herein may be applied.

FIG. 3 is a perspective view of an exemplary cooking apparatus to which a heating device as embodied and broadly described herein may be applied. This application of the heating device in a burner of a cooking apparatus it is exemplary in nature, and thus is not limited thereto, but can also be applied to numerous other devices, or alone, as appropriate.

The exemplary cooking apparatus may include a cooktop (C) provided with a plurality of burners 100. An oven (O) may be opened and closed by a door d disposed below the cooktop (C). The oven (O) may include, for example, a heater and a magnetron (not shown in FIG. 3) that heat a cooking room of the oven (O). A control panel (P) including a controller (not shown in FIG. 3) may control the cooking apparatus.

A plate 110 may be provided on an upper surface of the cooktop (C). The plate 110 may be made of, for example, a ceramic material, or other material as appropriate, and may be provided with indicia, such as, for example an indicating line delineating an accurate position of the burners 100. In alternative embodiments, the plate 110 may be transparent so that the burners 100 are visible therethrough. The plate 110 may be substantially planar for easy cleaning.

Figure 4:
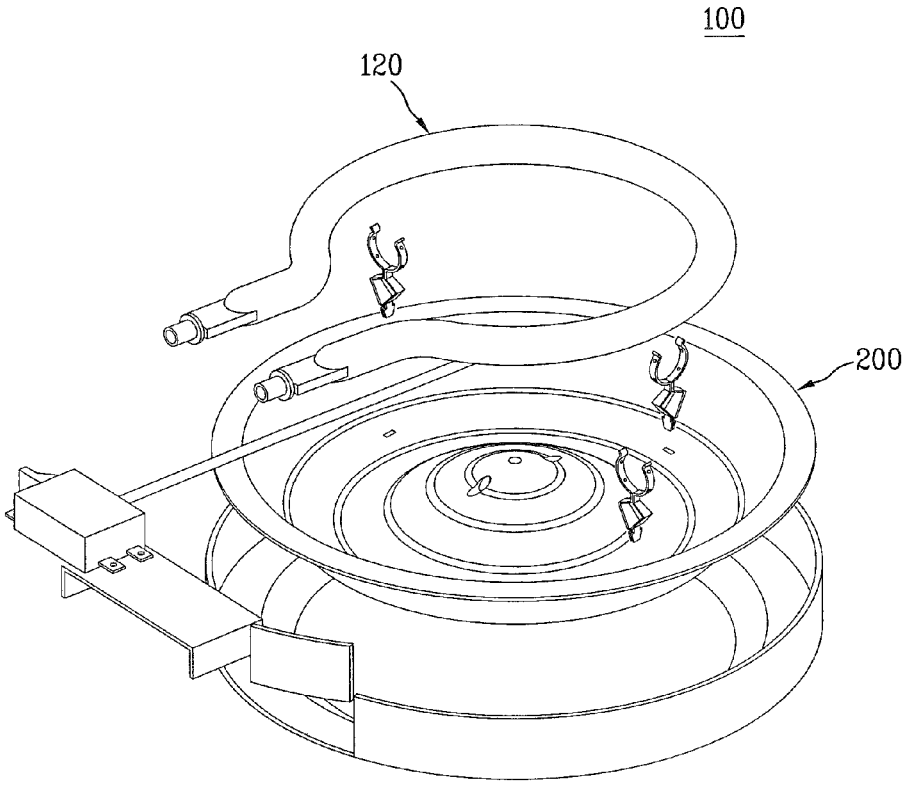
FIG. 4 is an exploded perspective view of a burner of the exemplary cooling apparatus shown in FIG. 3.

A plurality of burners 100 may be provided under the plate 110. As shown in FIG. 3, the burners 100 may have different sizes so that food can be cooked using various sizes of vessels. For example, at least one of the burners 100 may be elongated so as to heat a long vessel. The sizes and shapes of the burners 100 may be different, while the structures thereof may be substantially the same. For example, as shown in FIG. 4, a burner 100 may include a heat-generating heating device 120, and a reflecting plate 200 that reflects heat and light emitted by the heating device 120 to the plate 110.

Figure 5:
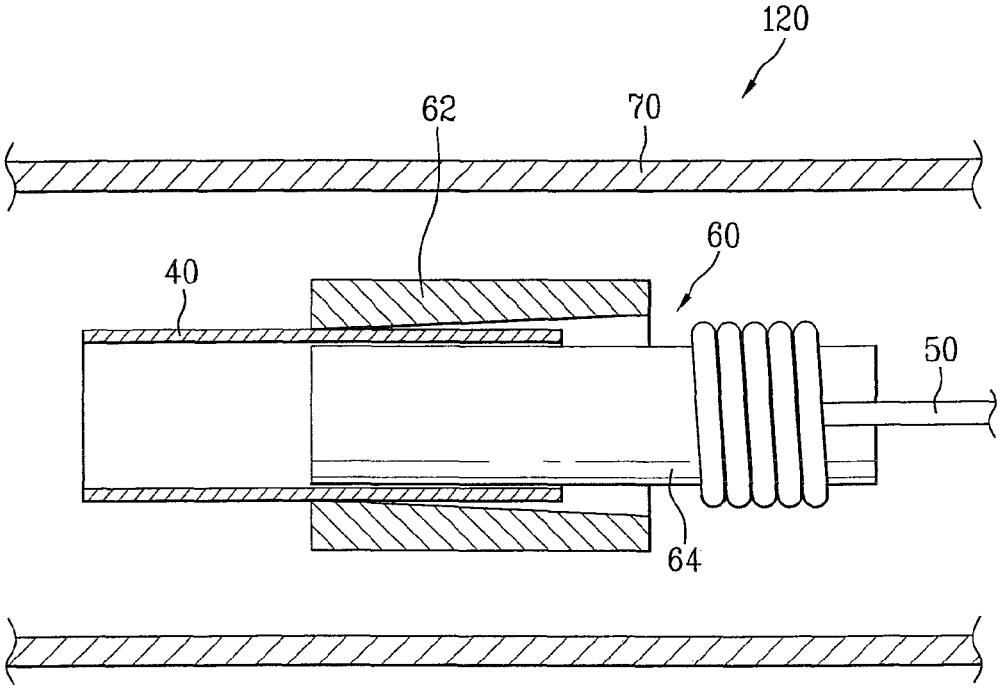
FIG. 5 is a cross-sectional view of a heating device in accordance with a first embodiment as broadly described herein.

A heating device 120 in accordance with the embodiment shown in FIG. 5 may include a heating element 40 that generates heat, an elastic conductive part 50 that supplies electricity to the heating element 40, and a connector 60 provided between the elastic conductive part 50 and the heating element 40. In certain embodiments, the heating element 40 may generate heat through electrical resistance. However, other means may also be appropriate, based on a particular application.

In certain embodiments fish trap type of a filament may be used as the heating element 40, and the filament may be made of carbon. Other filament materials, such as, for example, tungsten, may also be appropriate. The heating element 40 may be installed in a quartz tube 70.

The quartz tube 70 may be made of a chemically stabilized silicon dioxide SiO2, similar, for example, to that which is used in the semiconductor industry, requiring stability at high temperatures. More specifically, since softening of this type of quartz does not occur until approximately 1683° C., and a thermal expansion coefficient thereof is relatively small, a quartz tube 70 made of this type of stabilized $SiO_2$ is able to withstand rapid heating and cooling. Additionally, light in the ultraviolet region as well as the infrared region may be transmitted therethrough, and the quartz tube 70 provides a high degree of electrical isolation.

In certain embodiments, the connector 60 may be provided at both ends of the heating element 40 so as to fix the heating element 40 in place. The connector 60 may be made of an allotrope material having electrical properties similar to those of the heating element 40 in order to reduce contact resistance between the connector 60 and the heating element 40.

When a number of atoms forming a particular molecule is different, or when a chemical composition is the same but an arrangement state and bonding mode of the atoms is different, the resulting material is referred to as an allotrope. An allotrope is essentially a single-element material made of the same element, but which differs in shape and properties.

If the heating element 40 is used at a low power level, such as, for example, 500 W, a corresponding amount of an applied voltage and current is low so that the material of the connector 60 is not particularly limited. However, if the heating element 40 is used at a high power level, such as, for example, above 3.0 kW, the contact resistance of the connector 60 with the heating element 40 may result in abnormal heat-generation. Thus, the connector 60 may be made of an allotrope, which is a material similar in electrical properties to the heating element 40, to reduce or substantially eliminate the effects of the dissimilar materials in a high power, high heat environment.

In one embodiment, the connector 40 may be made of a graphite material, which is an allotrope of a heating element 40 made of carbon material. This arrangement may minimize contact resistance at the contact surface. In this instance, since the connector 60 is not a direct heating element, that is, an element having a high resistance, localized abnormal overheating does not occur between the connector 60 and the elastic conductive part 50.

More particularly, a connector 60 made of graphite material may be heat-treated in a vacuum, and may be subject to a process that removes remaining moisture and other gas included in the graphite. The connector 60 made of graphite material may have a predetermined thickness to supplement mechanical strength and provide the desired electrical properties.

An elastic conductive part 50 may be coupled to the connector 60. The elastic conductive part 50 may apply electricity to the heating element 40 through the connector 60. The elastic conductive part 50 may have a predetermined elasticity so as to uniformly maintain tension on the heating element 40 so that the heating element 40 is tautly drawn in the inside of the quartz tube 70. This may avoid contact between the heating element 40 and the tube 70 and subsequent localized burning/damage to the heating element 40 and/or tube 70.

The connector 60 may include a first fixed portion 62 having a hollow formed therein, and a second fixed portion 64 separated from the first fixed portion 62. In certain embodiments, the first fixed portion 62 may have a hollow cylindrical shape, and the second fixed portion 64 may have a solid, circular bar shape that may be inserted into the first fixed portion 62.

In certain embodiments, a diameter of the hollow formed in the first fixed portion 62 may be greater than an outer diameter of the second fixed portion 64. This allows the end of the heating element 40 to be inserted into a space formed between the first fixed portion 62 and the second fixed portion 64. In this manner, the first fixed portion 62 and the second fixed portion 64 may be coupled in a shape-fitting form, allowing the heating element 40 to be fixed between the first fixed portion 62 and the second fixed portion 64.

In certain embodiments, at least one of the inner surface of the first fixed portion 62 and the outer surface the second fixed portion 64 may be tapered. At least one of the inner circumference of the first fixed portion 62 or the outer circumference the second fixed portion 64 may be inclined, and the first fixed portion 62 and the second fixed portion 64 may be coupled by force fit, thereby making it possible to more firmly fix the heating element 40 in place therebetween.

The elastic conductive part 50 may be coupled to the end of the second fixed portion 64 opposite to the end which is contacted by the heating element 40. The elastic conductive part 50 may be made of a wire material such as, for example, molybdenum Mo, or nickel Ni, and a portion of the elastic conductive part 50 may be bent in a spring shape and wound about the second fixed portion 64. That is, a portion of the elastic conductive part 50 may have a certain degree of elasticity, like a spring, and thus elastically draw the second fixed portion 64 tight so that the heating element 40 coupled to the second fixed portion 64 is uniformly drawn and held taught, thereby maintaining an appropriate amount of tension.

As described above, if the second fixed portion 64 is solid, although the winding of the elastic conductive part 50 exerts a tightening force on the second fixed portion 64, the risk of damage to the second fixed portion 64 is reduced. Additionally, when the heating element 40 and the connector 60 are coupled in this manner, assembly may be simplified by inserting the heating element 40 into the inner circumferential surface of the first fixed portion 62, inserting one end of the second fixed portion 64 into the inner circumferential surface of the heating element 40, and then press fitting the first fixed portion 62 into the second fixed portion 64.

Figure 6:
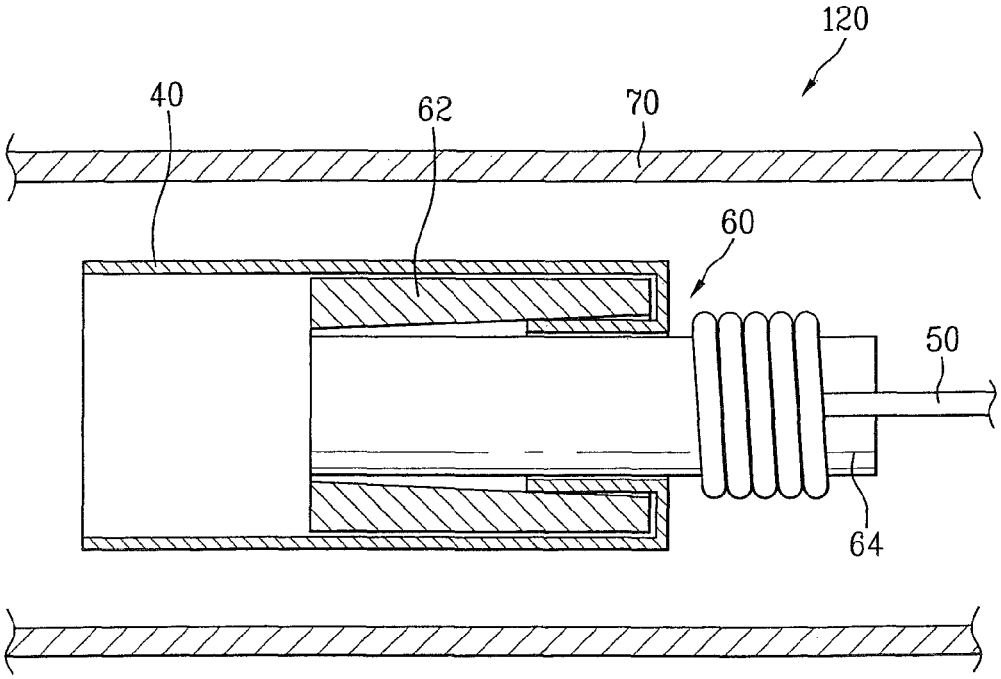
FIG. 6 is a cross-sectional view of an alternative coupling used in the heating device shown in FIG. 5.

In the embodiment shown in FIG. 6, the heating element 40 extends along an outer circumferential surface of the first fixed portion 62, down along an outer peripheral edge of the first fixed portion, and then inward along an inner circumferential surface of the first fixed portion 62. In this embodiment, the heating element 40 may be fixed by inserting the end of the heating element 40 facing the elastic conductive part 50 between the first fixed portion 62 and the second fixed portion 64. When so coupled, a contact area between the heating element 40 and the connector 60, and in particular, the first fixed portion 62, may be increased.

Figure 7:
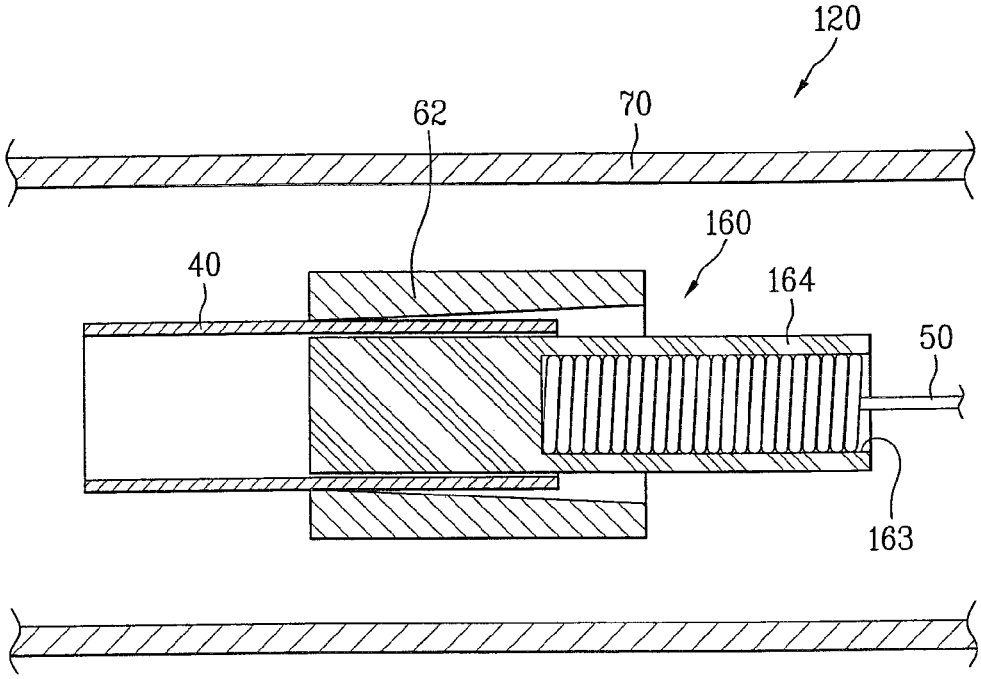
FIG. 7 is a cross-sectional view of a heating device in accordance with a second embodiment as broadly described herein.

In alternative embodiments, a groove 163 as shown in FIG. 7 may be formed at an end of a second fixed portion 164 of a connector 160, and the elastic conductive part 50 may be inserted into the groove 163. In this embodiment, the elastic conductive part 50 may first apply voltage to the connector 160, and the voltage applied to the connector 160 may then be applied to the heating element 40.

As described above, voltage applied by the elastic conductive part 50 may be supplied to the heating element 40 via a connector 160 which is made of an allotrope similar to the heating element 40 in electrical properties, and direct contact between the heating element 40 and the elastic conductive part 50 may be prevented, thus reducing or substantially eliminating the risk of defect generation due to localized overheating between the elastic conductive part 50 and the heating element 40.

Additionally, the more uniform surface contact between the heating element 40 and the connector 160 may provide a widened electrical path, thus reducing resistance and the risk of overheating.

Figure 8:
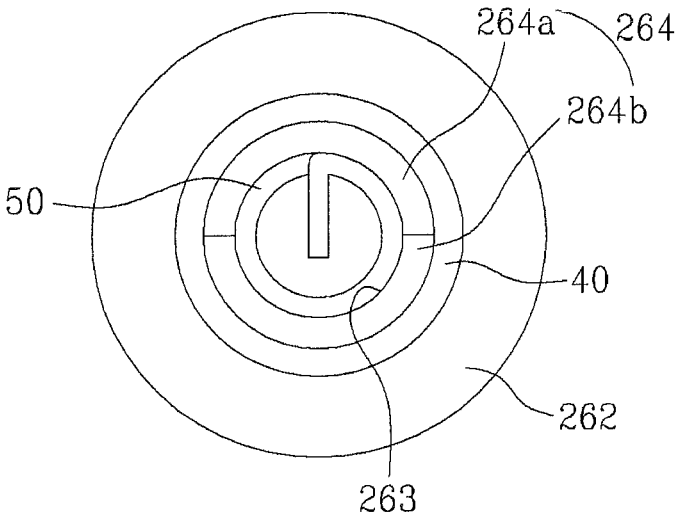
FIG. 8 is a cross-sectional view of a heating device in accordance with a third embodiment as broadly described herein.

Shapes of the first fixed portion and the second fixed portion are not limited to the embodiments as described above. For example, as shown in FIG. 8, a second fixed portion 264 may include two annular fixed pieces 264*a* and 264*b*. The second fixed portion 264 may be installed within a hollow portion of the heating element 40, with the outer circumferential surface of the second fixed portion 264 positioned against the inner circumferential surface of the heating element 40. The heating element 40 may then be installed within an inner circumference of a first fixed portion 262 that has a ring shape, with an outer circumferential surface of the heating element 40 positioned against an inner circumferential surface of the first fixed portion 262.

The inside of the second fixed portion 264 may include an inner hole 263 into which the elastic conductive part 50 may be inserted. Due to its elasticity, the elastic conductive part 50 inserted into the inner hole 263 presses outward against the two annular fixed pieces 264*a* and 264*b* of the second fixed portion 264, thus firmly fixing the heating element 40 in place between the first and second fixed portions 262 and 264.

Figure 9:
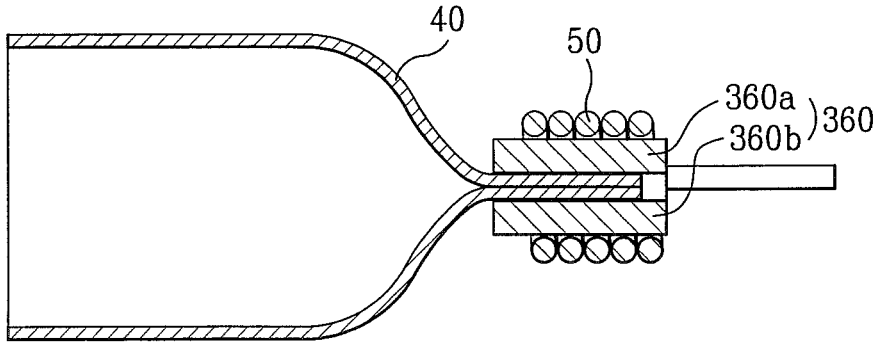
FIG. 9 is a cross-sectional view of a heating device in accordance with a fourth embodiment as broadly described herein.

A heating device as shown in FIG. 9 may include a heating element 40 that generates heat through, for example, electrical resistance, an elastic conductive part 50 that supplies electricity to the heating element 40, and a connector 360 provided between the elastic conductive part 50 and the heating element 40. The end of the heating element 40 may be inserted into the inside of the connector 360, and the elastic conductive part 50 may be installed on the outside of the connector 360 so as to press on an outer circumferential surface of the connector 360.

The connector 360 may be formed as two plates 360*a* and 360*b*, with the end of the heating element 40 inserted between the two plates 360*a* and 360*b* of the connector 360. The elastic conductive part 50 may be wound around an outer circumference of the connector 360 so as to elastically press on the connector 360, thereby exerting a force on the two plates 360*a* and 360*b* and fixing the heating element 40 in place therebetween.

The connector 360 may have any shape appropriate to receive and fix the heating element 40 in place and transfer voltage applied thereto by the elastic conductive part 50 to the heating element 40. The heating element 40 may be made of a carbon material and the connector 360 may be made of a graphite material in order to reduce contact resistance due to contact between the connector 360 and the heating element 40, as set forth above.

In accordance with embodiments as broadly described herein, voltage from the elastic conductive part may be supplied to the heating element via a connector made of an allotrope having similar electrical properties to those of the heating element, and direct contact between the heating element and the elastic conductive part may be reduced or substantially eliminated so as to reduce a risk of defect generation due to localized overheating between the elastic conductive part and the heating element.

Additionally, assembly of the connector and the elastic conductive part may be simplified, thus improving productivity.

A heating device as embodied and broadly described herein may include a heating element heat-generating by using an electrical resistance, an elastic conductive part applying electricity to the heating element and maintaining the tension of the heating element, and a connector provided between the elastic conductive part and the heating element so that the heating element and the elastic conductive part are not directly contacted, and having the heating element fixed in the one side thereof and the elastic conductive part fixed in the other side thereof to allow the current applied from the elastic conductive part to be flowed to the heating element.

The heating element and the connector may be made of allotrope material.

The heating element may be made of carbon material, and the connector may be made of graphite material.

In certain embodiments, the connector may include a first fixed portion formed in a hollow shape, and a second fixed portion whose one side is inserted into the inner circumference surface of the first fixed portion and the inner circumference surface of other side is coupled to the elastic conductive part, wherein the heating element can be fixed by allowing the end of the heating element to be inserted between the outer circumference surfaces of the first and second fixed portions.

In alternative embodiments, the connector may include a first fixed portion formed in a hollow shape, and a second fixed portion whose inside is made of a filled-up member, one side is inserted into the inner circumference surface of the first fixed portion and the outer circumference surface of other side is coupled to elastic conductive part, wherein the heating device is fixed by allowing the end of the heating element to be inserted between the outer circumference surfaces of the first and second fixed portions.

The second fixed portion may be formed in a cylindrical shape.

In certain embodiments, the heating element may surround the outer circumference surface of the first fixed portion and may be fixed by allowing the end of the heating element to be inserted from the side of the first and second fixed portions facing the elastic conductive part.

In certain embodiments, any one of the inner circumference surface of the first fixed portion and the outer circumference of the second fixed portion can be formed to be inclined.

The connector may be formed to allow the end of the heating element to be inserted therein, the elastic conductive part to be coupled to the outer circumference thereof, and the heating element to be pressed and fixed by means of the tightening force of the elastic conductive part.

A heating device as embodied and broadly described herein may include a heating element heat-generating by using an electrical resistance, an elastic conductive part applying electricity to the heating element and maintaining the tension of the heating element, and a connector provided so that the portion in the heating element to which the electricity is applied, forms surface contact.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heating device, comprising:

a heating element that generates heat;

a conductor including an elastic conductive part that conducts electricity to the heating element; and an electrically conductive connector positioned between the conductor and the heating element, wherein the heating element is coupled to a first side of the electrically conductive connector and the conductor is coupled to a second side of the electrically conductive connector so as to allow current to flow from the conductor to the heating element via the electrically conductive connector such that a conductive path extends from the conductor, through the electrically conductive connector and to the heating element, wherein the electrically conductive connector maintains surface contact with the heating element, and with the elastic conductive part so as to maintain the conductive path, wherein the electrically conductive connector comprises:

a first fixed portion having a first end and a second end and a cavity formed therein; and a second fixed portion made of an electrically conductive material, the second fixed portion having a first end and a second end, wherein the first end of the second fixed portion is configured to be inserted into the cavity in the first fixed portion and the second end of the second fixed portion is configured to be coupled to the conductor, and wherein an end of the heating element is configured to be inserted into an annular space formed between an inner circumferential surface of the first fixed portion and an outer circumferential surface of the second fixed portion.

2. The heating device of claim 1, wherein the heating element and the electrically conductive connector are made of allotrope materials.

3. The heating device of claim 2, wherein the heating element is made of a carbon material, and the electrically conductive connector is made of a graphite material.

4. The heating device of claim 1, wherein the conductor is configured to be coupled to an outer circumferential surface of the second end of the second fixed portion.

5. The heating device of claim 4, wherein the second fixed portion is solid and has a substantially cylindrical shape.

6. The heating device of claim 4, wherein the heating element is configured to surround the outer circumferential surface of the first fixed portion, and wherein the end of the heating element is configured to be slidably inserted into a space formed between the second ends of the first and second fixed portions, proximate the conductor.

7. The heating device of claim 6, wherein the heating element extends along the outer circumferential surface of the first fixed portion, down along an outer peripheral edge of the second end of the first fixed portion, and into the space formed between the inner circumferential surface of the first fixed portion and the outer circumferential surface of the second fixed portion.

8. The heating device of claim 7, wherein the end of the heating element forms a recess, and wherein the recess is configured to slidably receive the second end of the first fixed portion.

9. The heating device of claim 4, wherein at least one of the inner circumferential surface of the first fixed portion or the outer circumference of the second fixed portion is inclined.

10. The heating device of claim 4, wherein the elastic conductive part is configured to be wound around and surround the outer circumferential surface of the second fixed portion so as to exert a force on the heating element coupled thereto and maintain a predetermined amount of tension in the heating element.

11. The heating device of claim 4, wherein the heating element is configured to be slidably inserted into the space formed between the first and second fixed portions at the first ends of the first and second fixed portions, opposite the second ends thereof that are proximate the conductor.

12. The heating device of claim 1, further comprising a recess formed in the second end of the second fixed portion, wherein the recess is configured to receive the conductor therein.

13. The heating device of claim 12, wherein the elastic conductive part is configured to be wound within the recess so as to exert a force on the heating element coupled thereto and maintain a predetermined amount of tension in the heating element.

14. The heating device of claim 12, wherein the second fixed part comprises a first annular part and a second annular part, wherein the elastic conductive part positioned in the recess is configured to exert an outward radial force on the first and second annular parts that presses the heating element against the inner circumferential surface of the first fixing part.

15. The heating device of claim 1, wherein the heating element generates heat through electrical resistance.

16. The heating device of claim 1, wherein the elastic conductive part has a certain degree of elasticity, and wherein the elastic conductive part exerts a force on the heating element so as to maintain a predetermined amount of tension in the heating element.

17. The heating device of claim 1, wherein the electrically conductive connector is positioned between the conductor and the heating element such that there is no direct physical contact between the conductor and the heating element.

18. A heating device, comprising:

a heating element configured to generate heat;

a conductor including an elastic conductive part having a prescribed elasticity and configured to conduct electricity to the heating element and to exert a force on the heating element so as to maintain a predetermined level of tension in the heating element; and an electrically conductive connector configured to maintain surface contact between the heating element and the elastic conductor so as to form a conductive path that extends from the conductor, through the electrically conductive connector and to the heating element so as to maintain the conductive path, wherein the electrically conductive connector comprises;

a first fixed portion having a first end and a second end and a cavity formed therein; and a second fixed portion having a first end and a second end, wherein the first end of the second fixed portion is configured to be inserted into the cavity in the first fixed portion and the second end of the second fixed portion is configured to be coupled to the conductor, and wherein an end of the heating element is configured to be inserted into an annular space formed between an inner circumferential surface of the first fixed portion and an outer circumferential surface of the second fixed portion.

* * * * *